United States Patent [19]

Waters

[11] 4,442,709

[45] Apr. 17, 1984

[54] MEASURING VEHICLES FOR ROADWAYS

[75] Inventor: John M. Waters, Derby, England

[73] Assignee: British Railways Board, England

[21] Appl. No.: 298,352

[22] Filed: Sep. 1, 1981

[30] Foreign Application Priority Data

Sep. 5, 1980 [GB] United Kingdom ..... 8028813

[51] Int. Cl.[3] ..... E01B 35/00; B60D 1/00

[52] U.S. Cl. ..... 73/146; 33/338; 213/1 R

[58] Field of Search ..... 73/146; 33/338, 19, 33/287; 213/1 R; 105/101; 324/217, 218

[56] References Cited

U.S. PATENT DOCUMENTS 2,645,938 7/1953 Billstein ..... 73/146

*Primary Examiner*—Jerry W. Myracle

*Assistant Examiner*—John E. Chapman, Jr.

*Attorney, Agent, or Firm*—Hayes, Davis & Soloway

[57] ABSTRACT

A measuring vehicle for roadways comprises a tow vehicle and an instrument carrying vehicle connected for movement to the tow vehicle. The connection between the two vehicles includes a periodically operative lost motion arrangement so that as the tow vehicle moves continuously along the roadway, the instrument carrying vehicle automatically remains stationary periodically.

The connection between the tow vehicle and the instrument carrying vehicle advantageously comprises a connecting rod connected at one end to the instrument carrying vehicle and at its other end to an endless belt or chain revolving on guide means such as rollers or sprockets whose rotational speed is proportional to the speed of the tow vehicle.

8 Claims, 11 Drawing Figures

Velocity = Zero
Velocity = V
Velocity = 2V 1
2
5
7
9
10
11
41
42
43
44
45

MEASURING VEHICLES FOR ROADWAYS

This invention relates to measuring vehicles for roadways.

More particularly, but not exclusively, the invention is concerned with vehicles for measuring the geometry of railway track in order to provide data for the subsequent maintenance of the track or for assessing the effectiveness of a maintenance operation after it has been carried out. In one known method for measuring track geometry an inclinometer in the form of a gravity sensing device is mounted on the vehicle and the vehicle is moved along the track continuously while taking a series of readings. Such inclinometers are sensitive to extraneous acceleration forces on the vehicle and these acceleration forces have to be compensated for in the data processing to provide a true indication of track geometry.

It is the object of this invention to provide a measuring vehicle in which the need to compensate for extraneous acceleration forces is obviated.

According to the invention, a measuring vehicle for roadways comprises a tow vehicle and an instrument carrying vehicle connected for movement to the tow vehicle, the connection between the two vehicles including a periodically operative lost motion arrangement so that as the tow vehicle moves continuously along the roadway, the instrument carrying vehicle automatically remains stationary periodically.

By use of the term "tow vehicle" it is not only intended to include a pulling connection with the instrument carrying vehicle but also a pushing connection.

The connection between the tow vehicle and the instrument carrying vehicle advantageously comprises a connecting rod connected at one end to the instrument carrying vehicle and at its other end to an endless belt or chain revolving on guide means such as rollers or sprockets whose rotational speed is proportional to the speed of the tow vehicle.

Figures 1A, 1B, 1C, 1D:
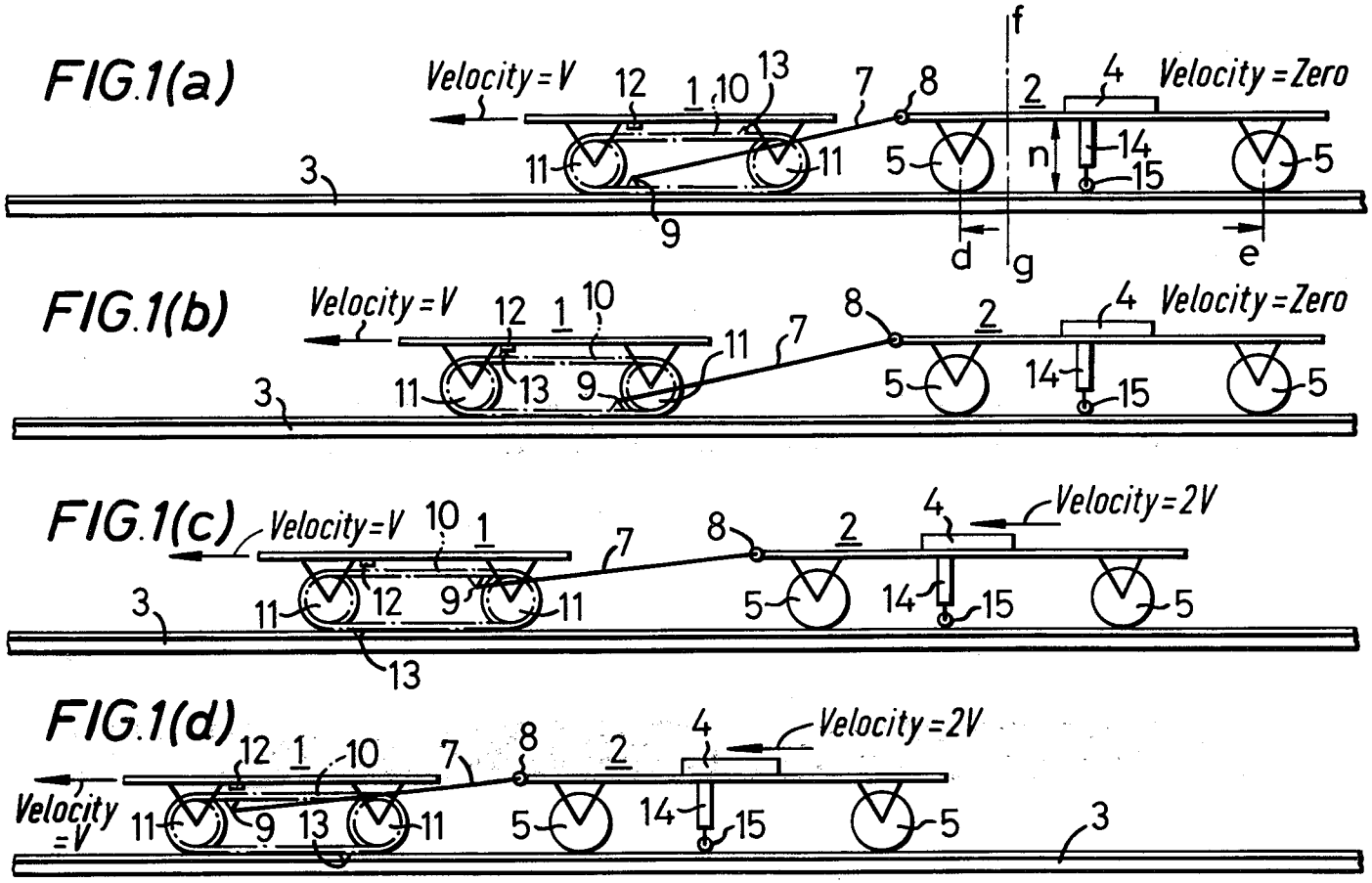

Embodiments of measuring vehicle comprising a tow vehicle and an instrument carrying vehicle in accordance with the invention will now be described by way of example with reference to the accompanying drawings, in which:

FIGS. 1(*a*)–1(*d*) show diagrammatically the relationship between the two vehicles at various stages as the tow vehicle moves continuously along the track in accordance with a first embodiment.

Figure 2C:
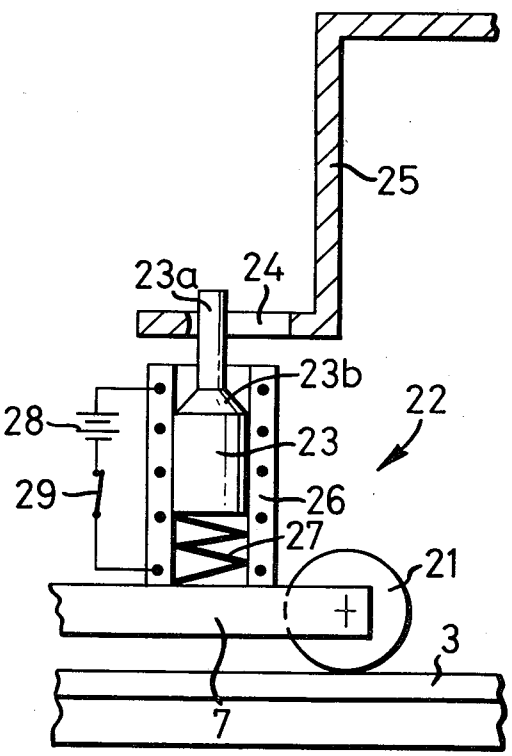
Figure 2B:
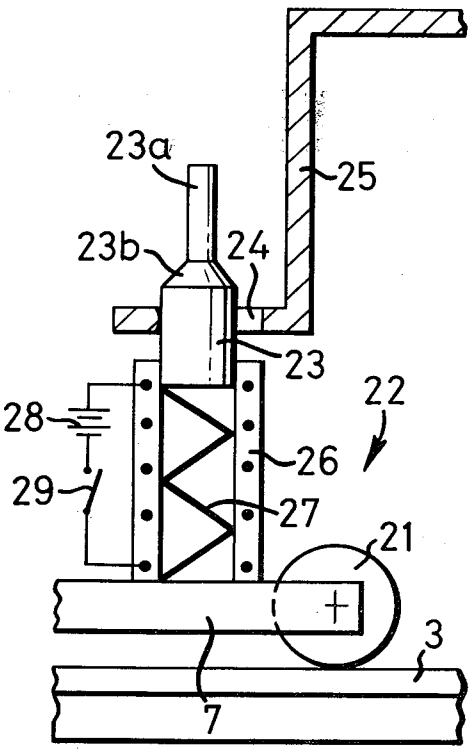
Figure 2A:
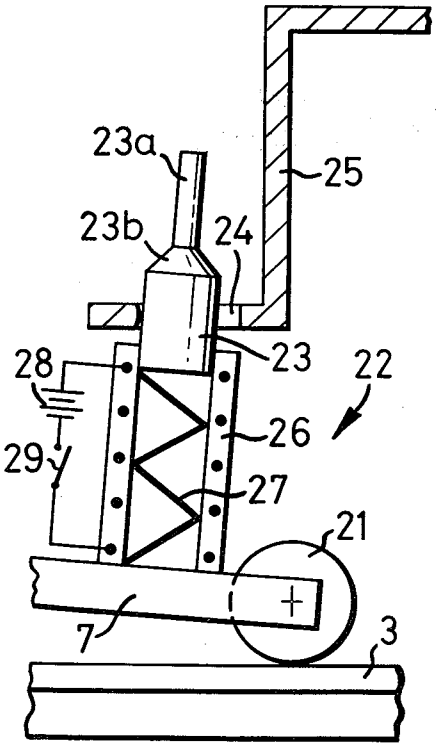
Figures 3A, 3B, 3C, 3D:
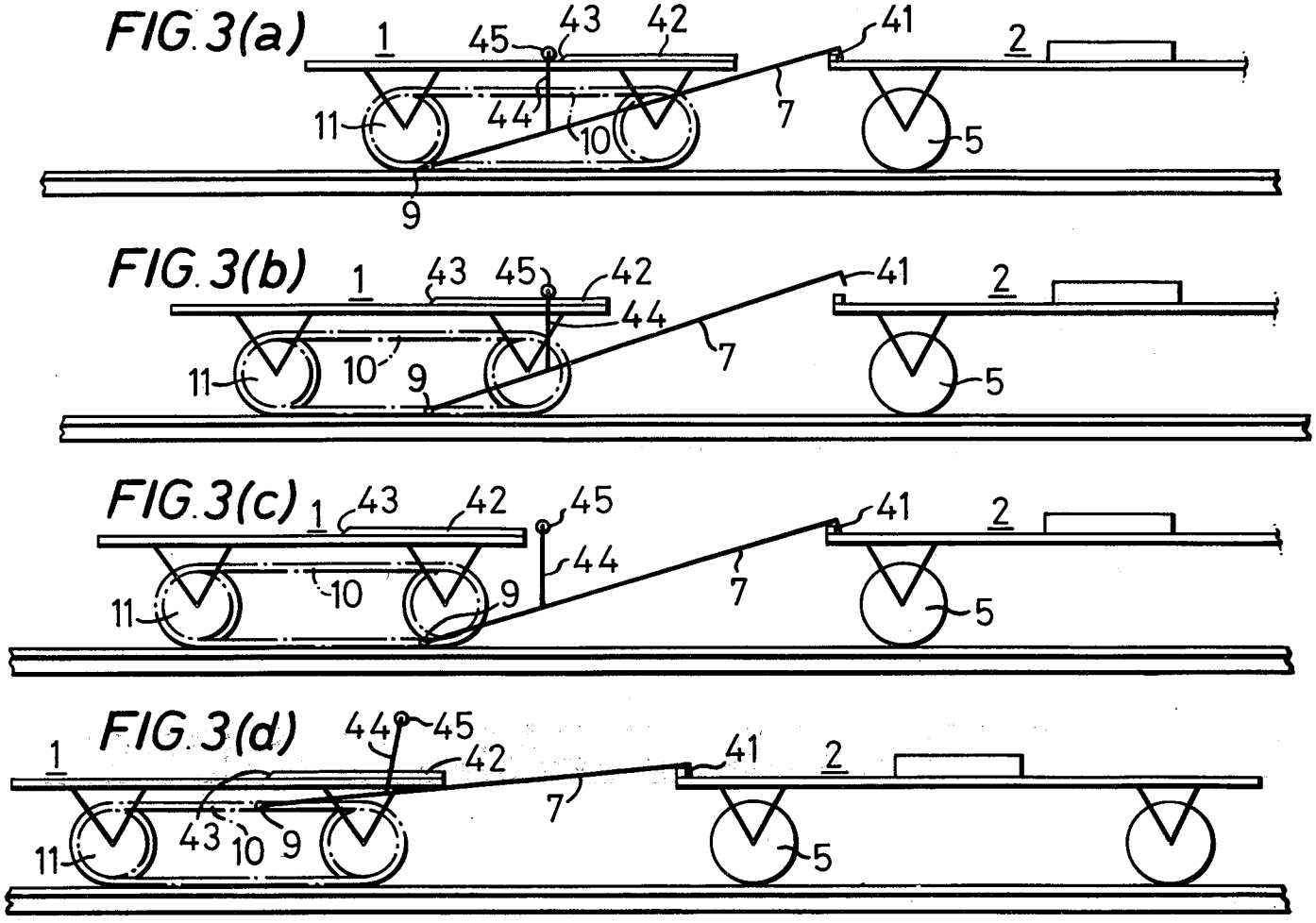

FIGS. 2(*a*)–2(*c*) show diagrammatically a modified form of towing connection between the tow vehicle and instrument carrying vehicle to that shown in FIG. 1, in various conditions as the tow vehicle moves continuously along the track, and FIGS. 3(*a*)–3(*d*) show a second modified form of towing connection at various stages as the tow vehicle moves continuously along the track.

Referring now to FIG. 1 the tow vehicle 1 and the instrument carrying vehicle 2 are shown running on railway track 3. Vehicle 2 carries an inclinometer 4 in the form of a gravity sensitive device, such as an accelerometer which is mounted over the rail on which the wheels 5 on the same side of the vehicle 2 run. The inclinometer 4 senses the longitudinal inclination of the vehicle 2 and hence of the rail with reference to the gravity vector fg over the gauge length de, which is equal to the wheelbase of the vehicle 2.

The vehicles 1 and 2 are interconnected by a rigid connecting rod 7. The rod 7 at one end is pivotally connected at 8 to the vehicle 2 and at its other end is pivotally connected at 9 to a chain 10 which runs on sprockets fixed to the wheels 11 of the vehicle 1, the diameter of the sprockets being the same as the wheel diameter. The length of the chain 10 is equal to the gauge length de; it is to be noted that the drawing is not to scale. Hence for one complete cycle of revolution of the chain 10, the vehicle 2 will move one gauge length de.

If the tow vehicle 1 moves forward at a velocity V the vehicle 2 will remain stationary for approximately half the cycle of revolution of the chain 10 during which the connection point 9 is stationary with respect to the track 3 as shown in FIGS. 1(*a*) and 1(*b*). The vehicle 2 will then travel at 2V for approximately the other half cycle so that at the end of a complete cycle of revolution of the chain 10 the vehicles 1 and 2 will have the same positional relationship as at the start. This can be readily appreciated from the different stages in the cycle shown in FIGS. 1(*a*)–1(*d*).

During the stationary period of the vehicle 2 the measurement is made by the inclinometer 4 and recorded. Since at this time there are no extraneous acceleration forces acting on the vehicle 2 no compensation has to be made for them in the measurement. During the continuous movement forward of the vehicle 1, the vehicle 2 will move forward in increments of one gauge length thereby allowing a continuously related record of changes in track slope to be obtained.

A switch 12 mounted on the body of the tow vehicle 1 and a switch actuator 13 mounted on the chain 10 allows a recording of the track slope to be taken from the inclinometer 4 at the optimum time, that is almost at the end of the stationary period so that the inclinometer 4 has had full opportunity to settle in its stationary position. The switch 12 and actuator 13 can also be used to operate a counter which will give a measure of the distance travelled along the track in units of gauge length de.

The tow vehicle 1 may be pushed or pulled by a machine or by hand, its correct function not being affected by variations in propulsion rate.

The addition of a second gravity sensitive accelerometer may be mounted on a cross member of the vehicle 2 to simultaneously measure transverse inclination of the vehicle 2 and hence the relative levels of the rails of the track, thereby to enable the longitudinal slope of the adjacent track rail to be deduced.

The addition of a further measuring system in the form of one or more potentiometers 14 mounted on the vehicle 1 or 2 and having a sliding contact movable by a feeler wheel 15 engaging the rail head will enable the dimension n to either be continuously measured as the vehicle 2 moves forward or measured at all points over the gauge length de while the vehicle 2 is stationary and so enables the shape of the track within the gauge length de to be reconstructed either in digital or graphical form.

The incorporation of a gyroscope on the vehicle 2 would enable curvature and line to be simultaneously measured. A track gauge measuring instrument could also be incorporated on the vehicle 2.

The tow vehicle 1 or instrument carrying vehicle 2 can with advantage carry a track marking device, e.g. a paint aerosol, operated by the switch 12 to facilitate the subsequent location on the track of geometric faults revealed by the measuring system.

Assuming that the vehicle 2 is provided with automatic data recording, the total measuring vehicle comprising vehicles 1 and 2 in combination can be operated by one man simply pushing or pulling the vehicle. No operator skill is required and there can be no operator error. Also the data can be produced in a form that can be readily processed and no separate longitudinal measurement of the track is required.

As an alternative to the chain 10 an endless belt running without slip around rollers fixed to the wheels 11 could be used.

As a further alternative arrangement the chain 10 or belt can run on sprockets or rollers one of which is the same diameter as the wheels 11 and is driven by one of the wheels 11. The other sprocket or roller may be a simple idling sprocket or roller and can be of any diameter.

In order to completely isolate the instrument carrying vehicle from the vibrations which might be transmitted to it by the tow vehicle at least when a measurement is being taken from the inclinometer, a mechanism can be provided in the tow connection to disconnect automatically the tow vehicle from the instrument carrying vehicle at the relevant time and then reconnect the two vehicles. One such mechanism is shown in FIG. 2.

Referring to FIG. 2 the connecting rod 7 is provided at its end remote from the tow vehicle 1 with a wheel 21 which supports it on one of the rails of the track 3. The instrument carrying vehicle 2 is connected to the rod 7 through a solenoid actuated coupling 22 which replaces the pivotal connection at 8 in FIG. 1. The coupling has a coupling pin 23 which constitutes the armature of the solenoid and is slidable vertically into and out of engagement with a coupling eye 24 in a coupling bracket 25 extending from the vehicle 2. The coupling pin 23 is slidably located in a solenoid coil 26 and is biased upwardly into engagement with the eye 24 by a spring 27. The solenoid coil 26 is energised from an electric supply 28 through a switch 29.

In operation, when the switch 29 is closed as shown in FIG. 2*c* the solenoid coil 26 is energised and coupling pin 23 is retracted from the coupling eye 24 against the bias of the spring 27 and the vehicle 2 is physically disconnected from the vehicle 1. When the switch 29 is open the solenoid coil 26 is de-energised and the coupling pin 23 is in engagement with the eye 24 as shown in FIGS. 2(*a*) and 2(*b*) to connect the vehicle 2 to the vehicle 1 for towing.

Relating the condition of the solenoid actuated coupling 22 of FIG. 2 with the relative positions of the vehicles 1 and 2 in FIG. 1, the condition shown in FIG. 2(*b*) corresponds to the vehicle positioning shown in FIG. 1(*a*), i.e. at the point where the switch 29 is about to be energised to effect retraction of the coupling pin 23. The condition shown in FIG. 2(*c*) i.e. the vehicle positioning when the measurement is being made, corresponds to a vehicle positioning between that of FIGS. 1(*a*) and 1(*b*) and the condition of FIG. 2(*a*) corresponds to the vehicle positioning of FIGS. 1(*c*) and 1(*d*).

The extension 23*a* of the coupling pin 23 provides emergency connection between the two vehicles 1 and 2 in the condition of the coupling shown in FIG. 2(*c*) should the power supply fail. The sloping shoulder 23*b* guides the pin 23 into the eye 24 should any slight relative movement horizontally have occurred between the pin 23 and eye 24 after they were decoupled.

In FIG. 3 a second decoupling mechanism is shown whereby the instrument carrying vehicle can be disconnected from the tow vehicle during the time a measurement is being taken from the inclinometer. In FIG. 3 the same references have been used as in FIG. 1 to designate corresponding parts.

The tow vehicle 1 is connected to the instrument carrying vehicle 2 by a connecting rod 7, which at one end is pivotally connected to the chain 10 at point 9 and at its other end is connected to the vehicle 2. Instead of the pivotal connection at the vehicle 2 as shown in FIG. 1 a releasable hook type coupling 41 is used. Provided on the vehicle 1 is raised platform 42 extending part way along the vehicle 1 from rear end thereof. At its front end the platform 42 has a ramp 43. An arm 44 is rigidly connected to the connecting rod 7 and extends upwardly therefrom. At its upper end the arm has a follower wheel 45 which when it runs up the ramp 43 on to the platform 42 lifts the rod 7 about its pivotal connection at 9 to unhook the coupling 41 and so disconnect the vehicle 2 from the vehicle 1.

The location of the ramp 43 along the vehicle 1 is such that the follower wheel 45 starts to run up it just after the connection point 9 and hence the vehicle 2 have become stationary with respect to the ground, i.e. just after the position shown in FIG. 3(*a*). As the vehicle 1 continues to move forwards the wheel 45 rides along the platform 42 until it eventually moves off its rear end as shown in FIG. 3(*c*) and reconnects the coupling 41.

When the connection point 9 moves forward again relatively to the ground the orientation of the connecting rod 7 maintains the coupling 41 connected to effect forward movement of the vehicle 2. At this time the wheel passes over the platform 42 at a height above it as shown in FIG. 3(*d*), and to the front of the vehicle 2. It then starts to move rearwardly again and is lowered at a position forward of the ramp 43 onto the vehicle 1 as the connection point 9 on the chain 10 moves downwardly over the front sprocket wheel and eventually reaches the position of FIG. 3(*a*) again.

I claim:

1. A measuring vehicle for roadways comprising a tow vehicle supported on the roadway, an instrument carrying vehicle supported on the roadway at two positions which are at a spacing from each other along the length of the instrument carrying vehicle and a connection between the tow vehicle and the instrument carrying vehicle comprising a connecting member extending between the two vehicles and a lost motion arrangement on the tow vehicle comprising rotatable guide means including at least one roller or sprocket connected to be rotated at a speed proportional to the speed of the tow vehicle and an endless belt or chain running on said guide means and driven by said roller or sprocket, said connecting member being connected to said belt or chain and the length of said belt or chain being proportional to said spacing so that as the tow vehicle moves continuously along the roadway the instrument carrying vehicle automatically remains stationary periodically and between each stationary period moves forward a distance proportional to said spacing.

2. A measuring vehicle according to claim 1, wherein the instrument carrying vehicle is a wheeled vehicle and the lost motion arrangement is such that between each stationary period of the instrument carrying vehicle, the latter moves forward a distance equal to its wheelbase.

3. A measuring vehicle according to claim 2, wherein the length of the belt or chain is equal to the wheelbase of the instrument carrying vehicle.

4. A mesuring vehicle according to claim 1, wherein the tow vehicle carries a switch and the belt or chain carries a switch actuator, the operation of the switch by the actuator being arranged to initiate a measuring and recording operation of instrumentation on the instrument carrying vehicle.

5. A measuring vehicle according to claim 4, wherein the actuator is positioned on the belt or chain so that it actuates the switch towards the end of each stationary period of the instrument carrying vehicle.

6. A measuring vehicle according to claim 1, wherein the connection between the tow vehicle and the instrument carrying vehicle includes a releasable coupling whereby the instrument carrying vehicle is physically decoupled from the tow vehicle during a part of each stationary period of the instrument carrying vehicle.

7. A measuring vehicle according to claim 6, wherein the releasable coupling comprises a solenoid actuated coupling which when the solenoid is energised releases the coupling.

8. A measuring vehicle according to claim 1 wherein the connection between the tow vehicle and the instrument carrying vehicle includes a releasable coupling whereby the instrument carrying vehicle is physically decoupled from the tow vehicle during a part of each stationary period of the instrument carrying vehicle and wherein the releasable coupling comprises a hook type coupling between said one end of the connecting member and the instrument carrying vehicle, and an actuating mechanism for the coupling comprises a ramped platform mounted on the tow vehicle and a follower member mounted on the connecting member such that when the follower rides onto said platform during movement of the tow vehicle while the instrument carrying vehicle is stationary, the connecting member is displaced to release said coupling.

* * * * *